US005330374A

United States Patent [19]

Ishino

[11] Patent Number: 5,330,374

[45] Date of Patent: Jul. 19, 1994

[54] JET PROPULSION SYSTEM

[75] Inventor: Tetsuya Ishino, Hamamatsu, Japan

[73] Assignee: Sanshin Kogyo Kabushiki Kaisha, Hamamatsu, Japan

[21] Appl. No.: 18,021

[22] Filed: Feb. 16, 1993

[30] Foreign Application Priority Data

Feb. 17, 1992 [JP] Japan ..... 4-61182

[51] Int. Cl.[5] ..... B63H 11/02

[52] U.S. Cl. ..... 440/42; 440/38; 440/88

[58] Field of Search ..... 440/38, 47, 46, 41–43, 440/88; 60/221; 114/270

[56] References Cited

U.S. PATENT DOCUMENTS

| | | | |
|---|---|---|---|
| 3,240,179 | 3/1966 | Van Ranst | 440/88 |
| 3,292,373 | 12/1966 | Tado | 60/221 |
| 3,306,046 | 2/1967 | Trapp | 440/46 X |
| 3,478,712 | 11/1969 | Fox | 440/41 |
| 3,785,327 | 1/1974 | Smith | 440/42 |
| 4,813,898 | 3/1989 | Nakase et al. | 440/38 X |
| 4,984,528 | 1/1991 | Kobayashi | 114/270 |

FOREIGN PATENT DOCUMENTS

| | | | |
|---|---|---|---|
| 2359371 | 11/1973 | Fed. Rep. of Germany | 440/88 |
| 58-45199 | 10/1983 | Japan . | |

*Primary Examiner*—Sherman Basinger

*Attorney, Agent, or Firm*—Knobbe, Martens, Olson & Bear

[57] ABSTRACT

A jet propulsion system for a small watercraft including an arrangement for isolating the sound of water flowing through the water inlet portion of the jet propulsion unit from the occupants of the watercraft. This silencing is provided by providing a double wall on at least the portion of the jet propulsion unit water inlet portion juxtaposed to the passenger compartment to provide an insulating jacket. Water may be filled in the insulating jacket and this water can be derived by filling it with the coolant which is circulated through the engine.

11 Claims, 5 Drawing Sheets

JET PROPULSION SYSTEM

BACKGROUND OF THE INVENTION

This invention relates to a jet propulsion system for a watercraft and more particularly to an improved sound deadening arrangement for watercraft jet propulsion units.

Jet propulsion units are becoming particularly popular as propulsion units for watercraft, Jet propulsion units are quite desirable for use in a particular type of small watercraft that is designed to be operated by only one rider either alone or with a small number of passengers. With such watercraft, the jet propulsion unit is normally positioned in a tunnel formed beneath the hull and which tunnel is juxtaposed to the passenger compartment.

As is well known, jet propulsion units for watercraft include a water inlet portion that forms a duct through which water is drawn from the body of water in which the watercraft is operating. This water is drawn by an impeller which is positioned to the rear of the water inlet duct and which is driven by a powering internal combustion engine. The water is then discharged rearwardly through a discharge nozzle under the action of the impeller for propelling the associated watercraft.

Although this type of propulsion unit has a number of advantages, the flow of water through the inlet duct is not uniform and pulsations occur due to the fact that the impeller has a number of individual blades, Although the effects of pulsations can be reduced by increasing the number of blades, an increasing number of blades can reduce the pumping efficiency. The pulsations which occur in the water in the inlet portion are transmitted through the housing of the jet propulsion unit to the passenger compartment of the associated vehicle and this is obviously objectionable.

It is, therefore, a principal object of this invention to provide an improved jet propulsion unit for a watercraft that will reduce the sound transmission.

It is a further object of this invention to provide an improved arrangement for deadening the sound in the water inlet portion of a watercraft jet propulsion unit.

It is a further object of this invention to provide an improved sound deadening arrangement for the water inlet portion of such a jet propulsion unit.

SUMMARY OF THE INVENTION

This invention is adapted to be embodied in a watercraft comprised of a hull which mounts a jet propulsion unit for propulsion of the watercraft. The jet propulsion unit is comprised of a water inlet portion forming a duct for drawing water from the body of water in which the watercraft is operating, an impeller portion containing an impeller for drawing the water and a discharge nozzle through which the pumped water is discharged for propelling the watercraft. In accordance with the invention, means are provided for providing a sound insulation around at least a portion of the jet propulsion unit.

DETAILED DESCRIPTION OF THE PREFERRED EMBODIMENTS OF THE INVENTION

Figure 1:
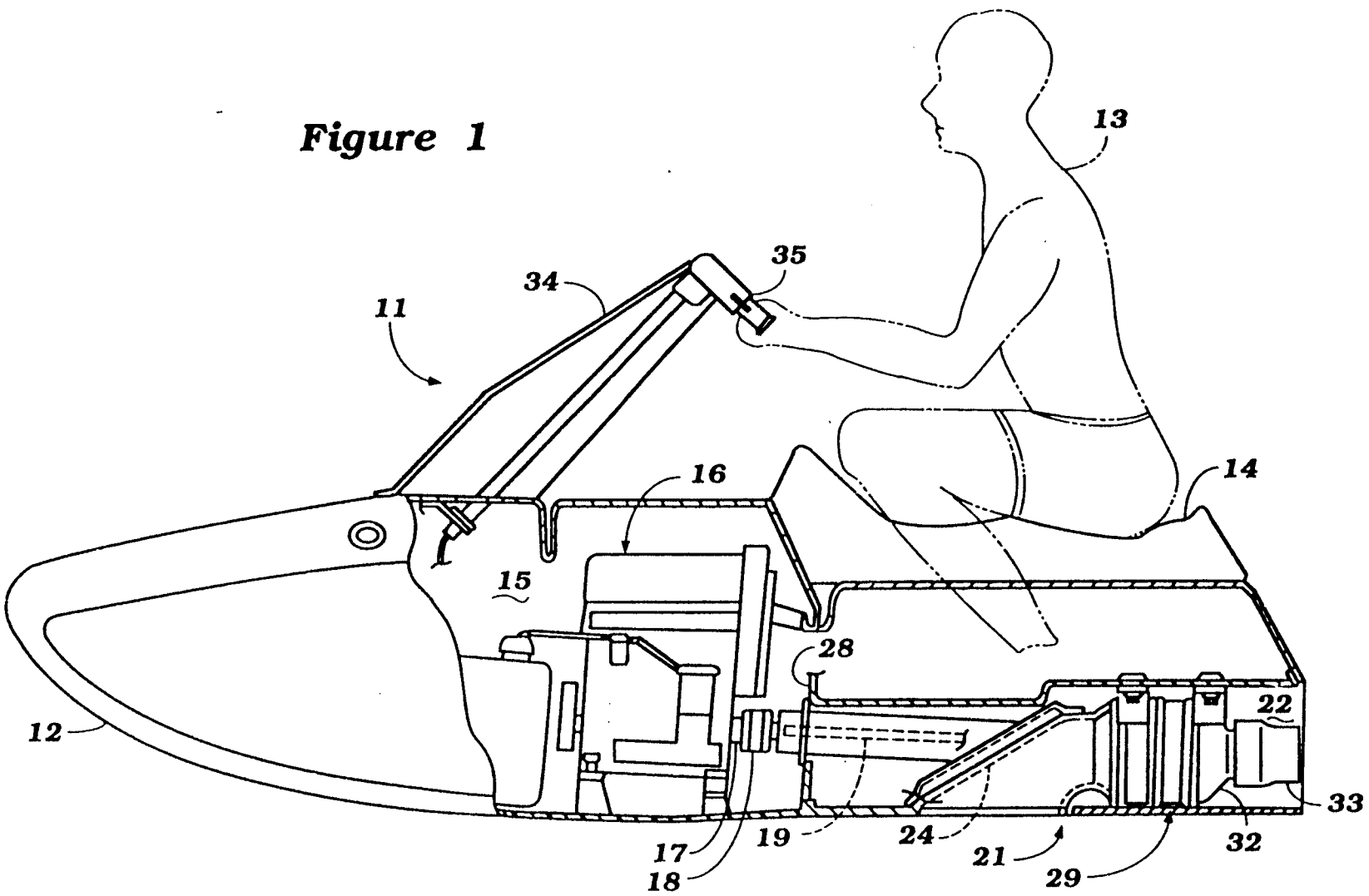
FIG. 1 is a side elevational view of a small watercraft propelled by a jet propulsion unit constructed in accordance with an embodiment of the invention, with a portion broken away and with the rider shown in phantom.
Figure 2:
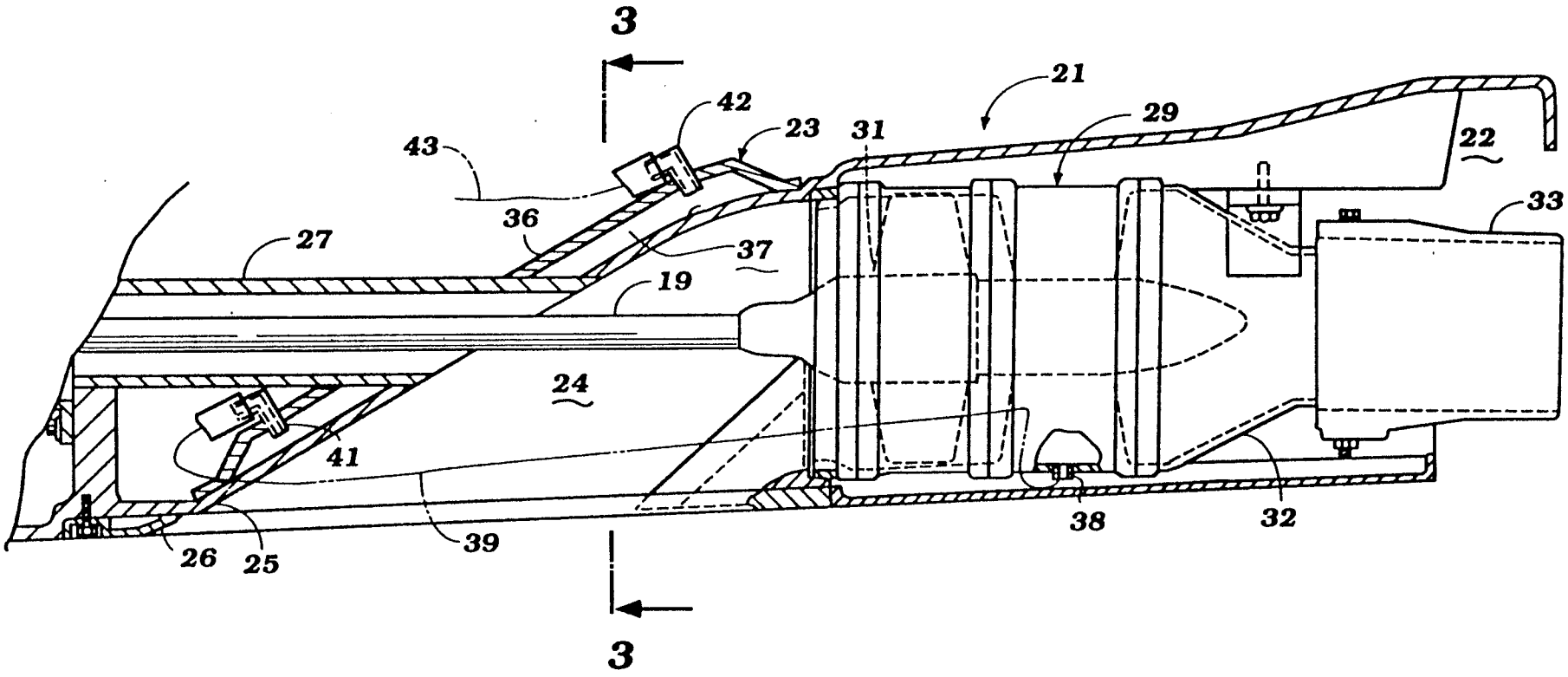
FIG. 2 is an enlarged cross-sectional view of the jet propulsion unit and the associated portion of the watercraft.
Figure 3:
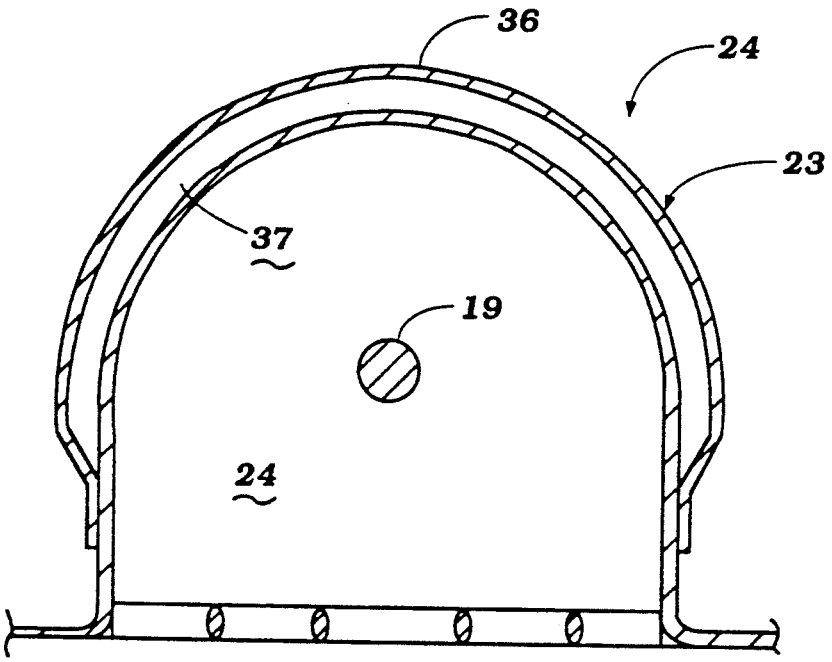
FIG. 3 is a cross-sectional view taken along the line 3—3 of FIG. 2.

Referring first to the embodiment of FIGS. 1-3 and initially to FIG. 1, a small watercraft constructed in accordance with an embodiment of the invention is identified generally by the reference numeral 11. The watercraft 11 is comprised of a hull 12 that may be formed from any suitable material such as a molded fiberglass reinforced resinous plastic. The watercraft 11, in the illustrated embodiment, is designed to be operated primarily by a single rider seated in straddle fashion, which rider is shown in FIG. 1 in phantom and identified by the reference numeral 13. The rider is seated upon a seat 14 carried by the hull 12 in an area which may be considered to be the passenger compartment. On the opposite sides of the seat 14, the hull 12 is provided with a pair of depressed areas in which the rider 13 may place his feet. These areas open through the rear of the watercraft hull 12 so as to facilitate the draining of water from the watercraft as well as the entry of the watercraft by the operator from the body of water in which the watercraft is operating.

Forwardly of the seat 14, the hull 12 is provided with an engine compartment area 15 in which a powering internal combustion engine 16 is mounted in a known manner. The engine 16 has an output shaft 17 which extends rearwardly and which is coupled by means of a flexible coupling 18 to an impeller shaft 19 of a jet propulsion unit, indicated generally by the reference numeral 21 and shown in more detail in FIGS. 2 and 3.

The jet propulsion unit 21 is positioned within a tunnel 22 formed within the hull 12 beneath the seat 14 and in proximity therefore to the passenger compartment where the rider 13 is positioned- The jet propulsion unit 21 is comprised of a water inlet portion, indicated generally by the reference numeral 23, and which forms a water inlet duct 24 that extends from a downwardly facing water inlet opening 25 that opens through an opening 26 in the lower portion of the hull 12. Water is drawn from the body of water in which the watercraft is operating through this opening 25 in the water inlet duct 24.

The impeller shaft 19 extends in part through the water inlet duct 24 and forwardly through a tubular member 27 which extends through an opening formed in a bulkhead 28 at the forward portion of the tunnel 22 for support for the impeller shaft 19 and to permit its connection to the engine output shaft 17 by the coupling 18.

Rearwardly of the water inlet portion 23, the jet propulsion unit outer housing includes an impeller portion 29 in which an impeller, shown in cross section in FIG. 2 and identified by the reference numeral 31, is supported for rotation. Upon rotation of the impeller 31, water will be drawn through the water inlet duct 24 and driven rearwardly through a plurality of straightening vanes (not shown) before discharge through a rearwardly facing discharge nozzle 32. A steering nozzle 33 is journaled for steering movement about a vertically extending axis by the discharge nozzle 32 for steering of the watercraft in a known manner.

Referring again to FIG. 1, a mast 34 is positioned forwardly of the rider's area and seat 14 and carries a handlebar assembly 35 that is coupled to the steering nozzle 33 for its steering in a known manner.

The construction of the jet propulsion unit 21 as thus far described may be considered to be conventional and since the internal details of the jet propulsion unit 21 form no part of the invention, additional description of these known components is not believed to be required.

As has been previously noted, the pumping action of the impeller 31 can cause pulsations to occur in the water in the water inlet duct 24 and these pulsations can be transmitted through the tunnel 22 to the rider's area and give rise to objectionable noises. In accordance with the invention, however, at least the upper side of the water inlet portion 23 is provided with a jacket 36 which may be formed by an additional sheet metal portion affixed to the main housing assembly of the jet propulsion unit 21 and which defines a sound deadening chamber 37. In order to further assist in the sound deadening, the chamber 37 is filled with water. In this embodiment, this is done by circulating the cooling water which is circulated through the engine 16 first through the jacket 37. To this end, there is provided a water outlet nipple 38 in the straightening section of the impeller portion 29 to which water is delivered under pressure by the action of the impeller 31. A flexible conduit 39 interconnects the nipple 38 with a fitting 41 which admits water into the lower portion of the jacket 37. This water then flows upwardly through the jacket 37 and is discharged through an outlet fitting 41 and flexible conduit 43 to the cooling jacket of the engine 16 in a well known manner. As a result of this construction, the pulsations which may occur in the water inlet duct 27 will be effectively isolated from the rider 13.

Figure 4:
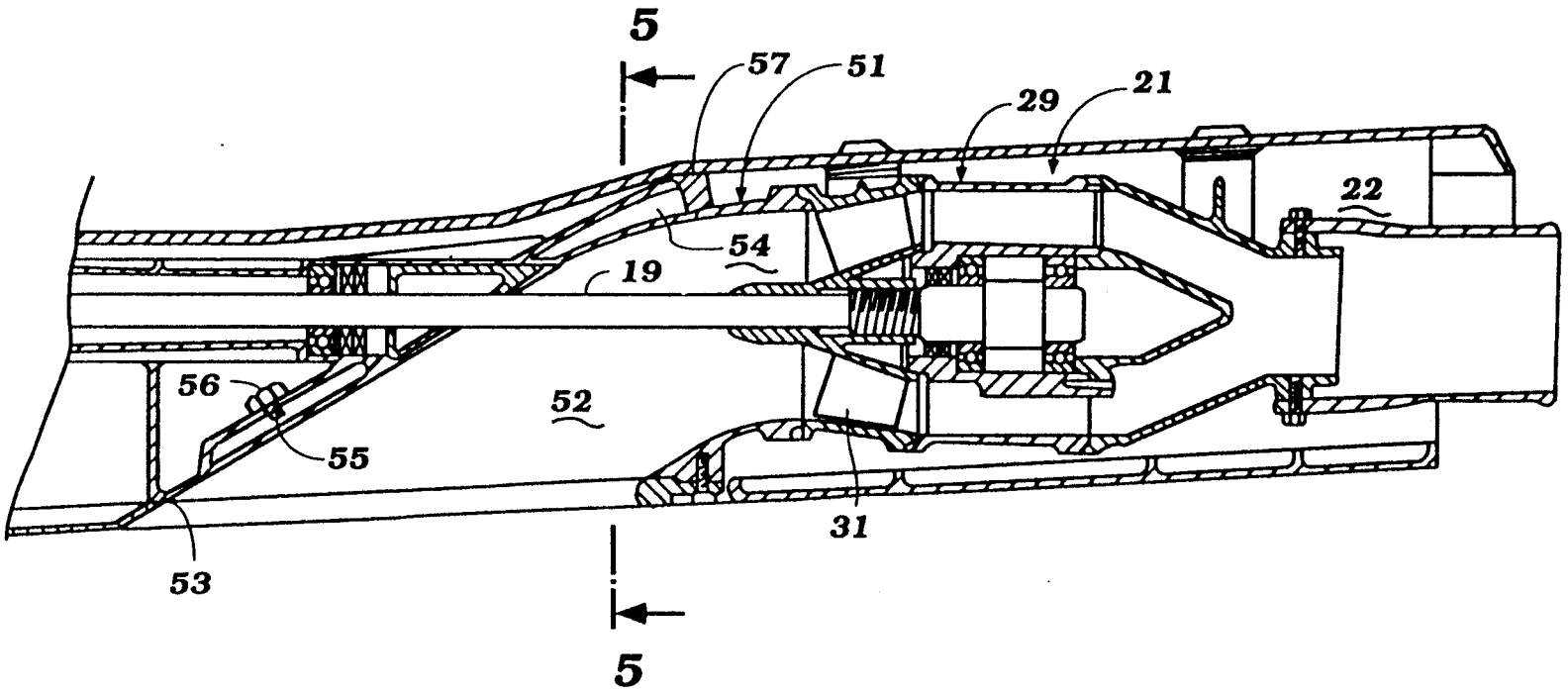
FIG. 4 is a cross-sectional view, in part similar to FIG. 2, and shows another embodiment of the invention.
Figure 5:
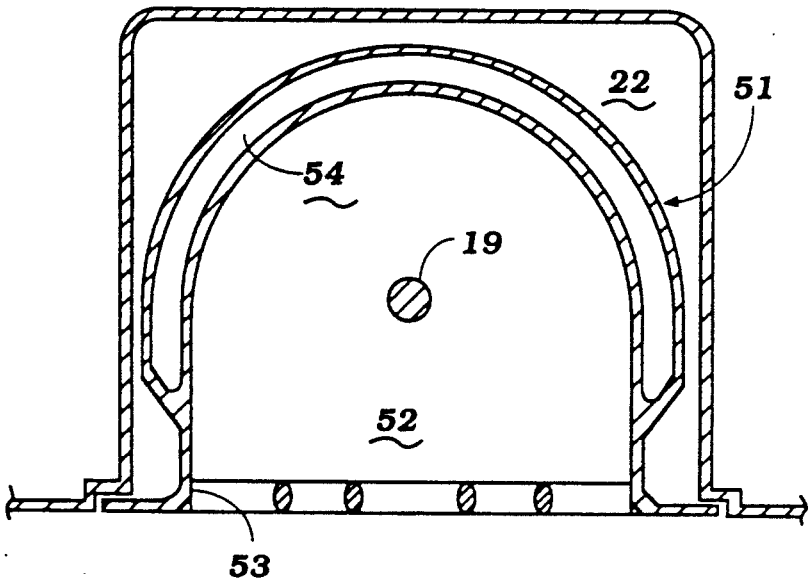
FIG. 5 is a cross-sectional view taken along the line 5—5 of FIG. 4.

FIG. 4 and 5 show another embodiment of the invention which is generally the same as the embodiment of FIGS. 1–3 and, for that reason, components which are the same or substantially the same as the previously described embodiment have been identified by the same reference numerals. FIG. 4 shows further details of the internal construction of the jet propulsion unit but since these details may be considered to be conventional, they will not be described further.

In this embodiment, the jet propulsion unit 21 has a water inlet portion 51 which defines a water inlet duct 52 that extends from a downwardly facing water inlet opening 53. In this embodiment, the water inlet portion 51 also has a double wall so as to form an insulating jacket 54. In this embodiment, this construction is integral rather than being formed from a separate member. The insulating jacket 54 is adapted to be filled with water in an appropriate manner. A drain opening 55 may be formed for this purpose and a drain plug 56 normally closes the jacket 54 when it is filled with water. Hence, no water will be circulated through the jacket 54 but nevertheless the jacket 54 will serve its silencing function as with the previously described embodiment. During periods of non-use or storage, the jacket 54 in this embodiment can be drained of water to reduce the likelihood of corrosion or encrustation by the removal of the drain plug 56.

A seal is formed at the upper end of the jacket 54 by a sealing member 57 which may be provided in any suitable manner.

It should be readily apparent from the foregoing description that the described embodiments of the invention are extremely effective for providing silencing of the jet propulsion unit and the insulation of noise from the passenger compartment of an associated watercraft. Of course, the foregoing description is that of preferred embodiments of the invention and various changes and modifications may be made without departing from the spirit and scope of the invention, as defined by the appended claims.

I claim:

1. A watercraft comprised of a hull, a jet propulsion unit mounted by said hull for propulsion of said watercraft, said jet propulsion unit being comprised of an outer housing comprised of a water inlet portion forming a water inlet opening and water inlet duct for drawing water from the body of water in which said watercraft is operating, said water inlet portion of said outer housing terminating at an outer housing impeller portion containing an impeller for pumping the water and an outer housing discharge nozzle, and means for providing with said outer housing an enclosed sound insulation jacket extending around at least a portion of said jet propulsion unit outer housing from substantially said water inlet opening to substantially said impeller portion.

2. A watercraft as set forth in claim 1 wherein the sound insulation jacket is provided at least around a part of said outer housing surrounding an impeller shaft driving the impeller and extending through a part of the water inlet duct for connection to a driving engine.

3. A watercraft as set forth in claim 2 wherein the sound insulation is provided by a double wall section of the water inlet portion.

4. A watercraft as set forth in claim 3 further including means for filling the sound insulation jacket with water.

5. A watercraft as set forth in claim 4 wherein the means for filling the sound insulation jacket with water comprises means for circulating water through said sound insulating jacket.

6. A watercraft as set forth in claim 1 wherein the jet propulsion unit is mounted within a tunnel formed in the hull of the watercraft and which tunnel is juxtaposed to a passenger compartment.

7. A watercraft as set forth in claim 6 wherein the water inlet portion is mounted in the tunnel in an area in proximity to a seat within the rider's area.

8. A watercraft as set forth in claim 1 wherein the sound insulation jacket is provided at least around a part of said outer housing surrounding a part of the water inlet duct for connection to a driving engine.

9. A watercraft as set forth in claim 8 wherein the sound insulation is provided by a double wall section of the water inlet portion.

10. A watercraft as set forth in claim 9 further including means for filling the sound insulation jacket with water.

11. A watercraft as set forth in claim 10 wherein the means for filling the sound insulation jacket with water comprises means for circulating water through said sound insulating jacket.

* * * * *